US006276669B1

(12) United States Patent
Yang

(10) Patent No.: US 6,276,669 B1
(45) Date of Patent: Aug. 21, 2001

(54) BUBBLE GENERATING DEVICE

(75) Inventor: Chien-Nan Yang, Tainan (TW)

(73) Assignee: Dah Yang Toy Industrial Co., Ltd., Tainan (TW)

( * ) Notice: Subject to any disclaimer, the term of this patent is extended or adjusted under 35 U.S.C. 154(b) by 0 days.

(21) Appl. No.: 09/534,917

(22) Filed: Mar. 23, 2000

Related U.S. Application Data

(63) Continuation-in-part of application No. 09/474,689, filed on Dec. 29, 1999.

(51) Int. Cl.[7] ..... B01F 3/04

(52) U.S. Cl. ..... 261/30; 261/64.1; 261/122.2; 261/124

(58) Field of Search ..... 261/30, 38, 64.1, 261/122.1, 122.2, 124; 43/57; 119/215

(56) References Cited

U.S. PATENT DOCUMENTS 1,792,285 * 2/1931 Curry et al. ..... 261/122.2
2,376,733 * 5/1945 Testin ..... 261/30
3,664,647 * 5/1972 Snow et al. ..... 261/64.1
3,920,550 * 11/1975 Farrell, Jr. et al. ..... 261/64.1
4,029,581 * 6/1977 Clough, Jr. et al. ..... 261/122.2
5,167,877 * 12/1992 Pai ..... 261/30

* cited by examiner

*Primary Examiner*—C. Scott Bushey
(74) *Attorney, Agent, or Firm*—Christenson O'Connor Johnson Kindness PLLC

(57) ABSTRACT

A bubble generating device is to be used with a water tank which has a water receiving chamber, and includes a bubble emission member adapted to be disposed in the water receiving chamber and formed with bubble emission holes, an air pump for providing pressurized air, a first air passage tube with a first end connected to the air pump and an opposite second end, and a second air passage tube with a first end connected to the bubble emission member and an opposite second end. The control unit includes a cam wheel, a valve seat formed with an air chamber which communicates fluidly the second ends of the first and second air passage tubes, and a spring-loaded piston rod with a first end portion in contact with a peripheral cam surface of the cam wheel and a second end portion extending into the air chamber and provided with a valve piece. A drive unit is coupled to the cam wheel for driving rotation of the cam wheel so as to permit the cam surface to intermittently push the piston rod toward the air chamber to enable the valve piece to alternatingly block and unblock air flow through the air chamber from the second end of the first air passage tube to the second end of the second air passage tube.

10 Claims, 8 Drawing Sheets

BUBBLE GENERATING DEVICE

CROSS-REFERENCE TO RELATED APPLICATION

This application is a continuation-in-part (CIP) of U.S. patent application Ser. No. 09/474,689, filed on Dec. 29, 1999, the entire disclosure of which is incorporated herein by reference.

BACKGROUND OF THE INVENTION

1. Field of the Invention

The present invention relates to a bubble generating device for a water tank, more particularly to a bubble generating device which is capable of intermittently controlling the emission of bubbles in the water tank.

2. Description of the Related Art

Bubble generating devices are commonly installed in a water tank, such as an aquarium tank, for aerating the water received therein so as to increase oxygen content in the water. A conventional bubble generating device includes a bubble emission member disposed in the tank, and an air pump connected fluidly to the bubble emission member for providing pressurized air to the bubble emission member such that bubbles can be emitted from the bubble emission member. However, when the conventional bubble generating device is in use, bubbles are continuously emitted from the bubble emission member while the air pump is activated. The scene created by the continuously emitted bubbles in the water tank is relatively monotonous. It is desirable to provide a bubble generating device that provides a varying waterscape in a water tank to result in an enhanced aesthetic effect.

In co-pending U.S. patent application Ser. No. 09/474,689, the Applicant disclosed a bubble generating device for use with a water tank so as to provide the water tank with a varying waterscape. The bubble generating device disclosed in the aforementioned patent application includes a bubble emission member adapted to be disposed in a water receiving chamber of the water tank and formed with a plurality of bubble emission holes, an air pump for providing pressurized air, air passage means for fluidly communicating the air pump and the bubble emission member to permit flow of the pressurized air from the air pump to the bubble emission member, and a control unit for intermittently controlling air flow through the air passage means so as to intermittently control the amount of bubbles emitted from the bubble emission holes of the bubble emission member.

SUMMARY OF THE INVENTION

The main object of the present invention is to provide a modified bubble generating device of the type disclosed in the aforementioned patent application.

Accordingly, the bubble generating device of the present invention is to be used with a water tank which has a water receiving chamber to hold water therein, and includes a bubble emission member, an air pump, a first air passage tube, a second air passage tube, and a control unit. The bubble emission member is adapted to be disposed in the water receiving chamber of the water tank, and is formed with a plurality of bubble emission holes. The air pump provides pressurized air. The first air passage tube has a first end connected to the air pump for receiving the pressurized air provided by the air pump, and an opposite second end. The second air passage tube has a first end connected to the bubble emission member, and an opposite second end. The control unit includes a cam wheel, a valve seat, a spring-loaded piston rod and a drive unit. The cam wheel is rotatable about a rotary axis, and has a peripheral cam surface. The valve seat is formed with an air chamber, an air inlet communicated fluidly with the air chamber and connected to the second end of the first air passage tube for fluidly communicating therewith, and an air outlet communicated fluidly with the air chamber and connected to the second end of the second air passage tube for fluidly communicating therewith. The piston rod has a first end portion extending toward the peripheral cam surface of the cam wheel, and a second end portion which extends into the air chamber of the valve seat and which is disposed between the air inlet and the air outlet. The second end portion of the piston rod is provided with a valve piece. The piston rod is biased to move toward the cam wheel to keep the first end of the piston rod in contact with the peripheral cam surface of the cam wheel. The drive unit is coupled to the cam wheel for driving rotation of the cam wheel so as to permit the cam surface to intermittently push the piston rod toward the air chamber to enable the piston rod to move intermittently between a blocking position, in which air flow from the air inlet to the air outlet is blocked by the valve piece on the second end portion of the piston rod, thereby preventing air flow from the first air passage tube to the second air passage tube so as to prevent emission of bubbles via the bubble emission body, and a non-blocking position, in which the valve piece ceases to block the air flow from the air inlet to the air outlet, thereby permitting air flow from the first air passage tube to the second air passage tube and permitting emission of bubbles via the bubble emission body.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
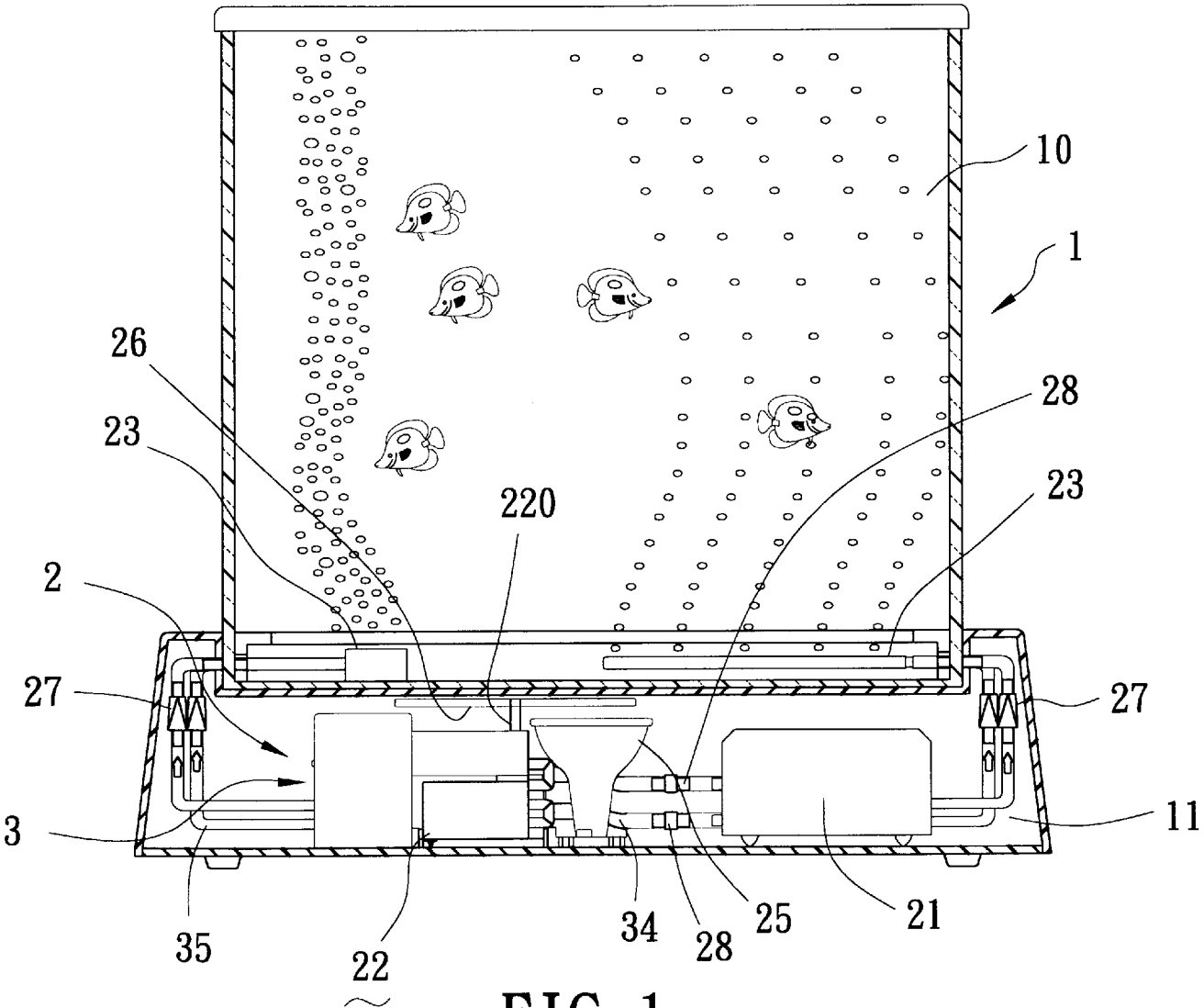
FIG. 1 is a schematic view of a preferred embodiment of the bubble generating device of the present invention when installed on a water tank.

Referring to FIG. 1, the preferred embodiment of the bubble generating device of the present invention is shown to be adapted to be installed in a water tank 1, such as an aquarium tank, which has a housing formed with a water receiving chamber 10 to hold water therein, and a transmission chamber 11 below the water receiving chamber 10. The bubble generating device 2 includes an air pump 21, four bubble emission members 23 (only two are visible in FIG. 1), four first air passage tubes 34' (see FIG. 5), four second air passage tubes 35, and a control unit 3.

Figure 2:
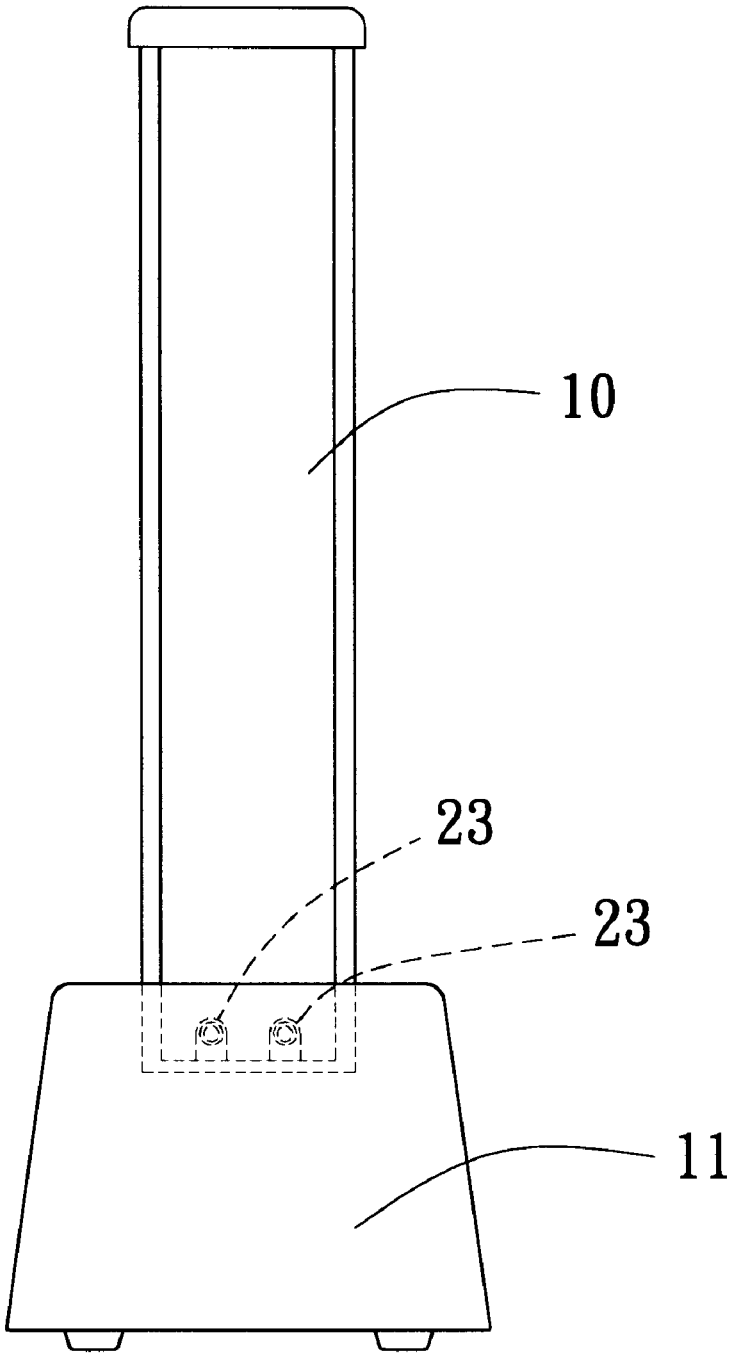
FIG. 2 is a side view of the water tank, illustrating a pair of bubble emission members of the bubble generating device of the preferred embodiment.
Figure 4:
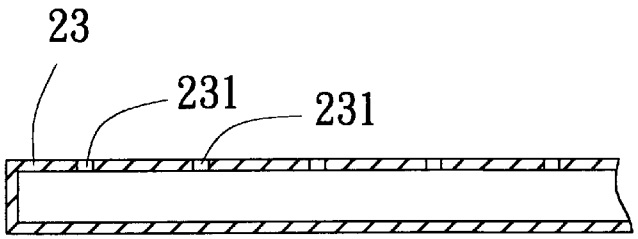
FIG. 4 is a fragmentary sectional view illustrating another one of the bubble emission members of the preferred embodiment.
Figure 3:
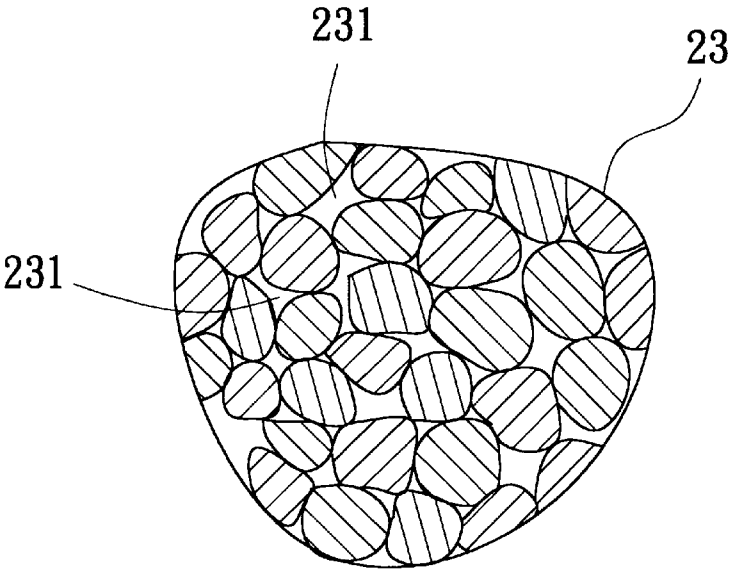
FIG. 3 is an enlarged sectional view illustrating one of the bubble emission members of the preferred embodiment.

Referring to FIGS. 1 and 2, the bubble emission members 23 are adapted to be disposed in the water receiving chamber 10 and to be immersed in the water received in the latter. A first pair of the bubble emission members 23 are disposed adjacent to a left side of the water tank 1. A second pair of the bubble emission members 23 are disposed adjacent to a right side of the water tank 1 and opposite to the first pair of the bubble emission members 23, respectively. The bubble emission members 23 may be in various forms. FIG. 3 shows a first type of the bubble emission members 23, which has an appearance of a rock and which is formed with a plurality of bubble emission holes 231 therein to permit emission of bubbles therefrom. FIG. 4 shows a second type of the bubble emission members 23, which is tubular in shape, and which is formed with a plurality of radial bubble emission holes 231. Preferably, the bubble emission holes 231 in the bubble emission members 23 of the bubble generating device of the present invention are different in size such that the bubbles emitted therefrom have different sizes.

Figure 5:
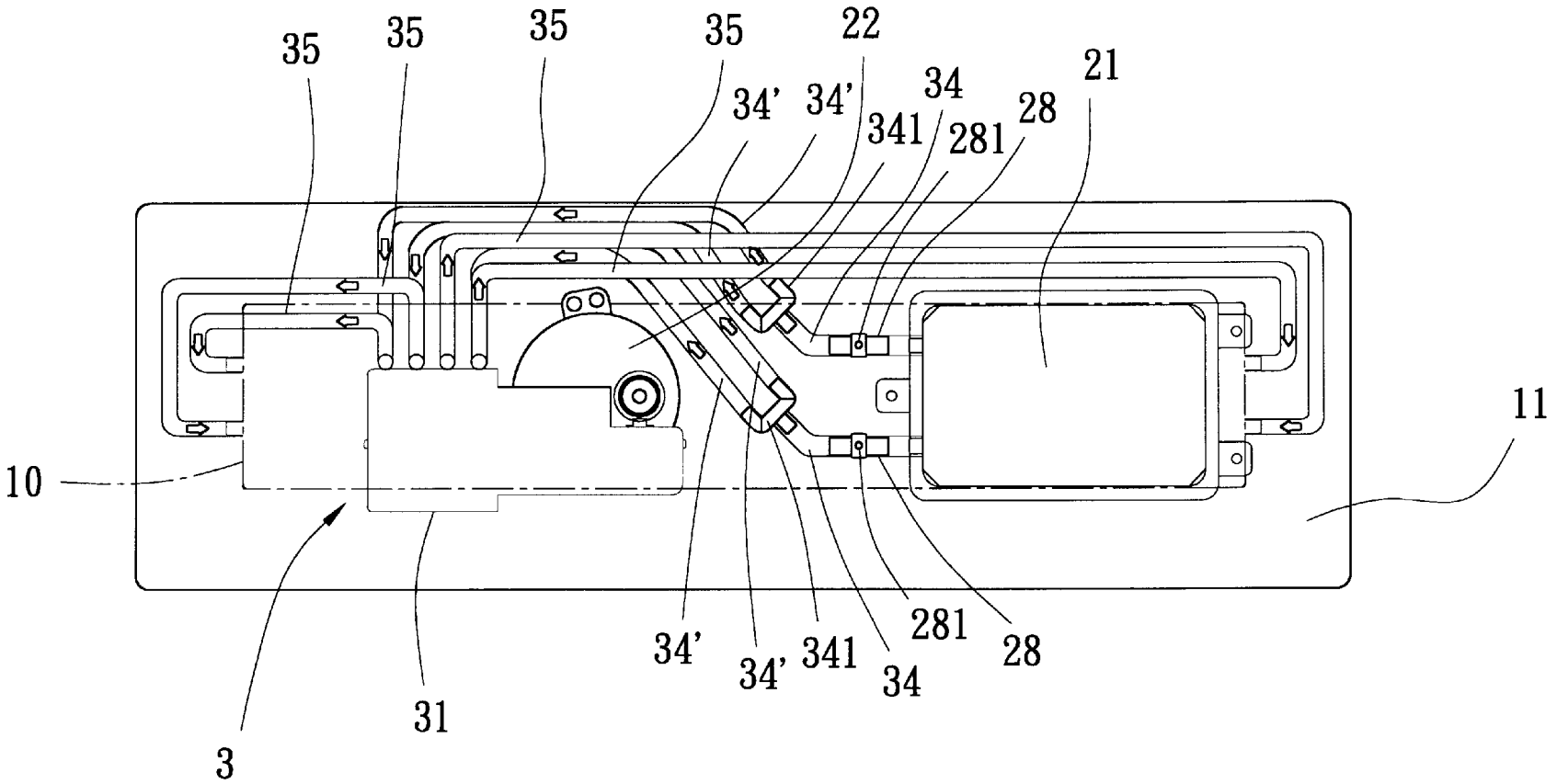
FIG. 5 is a top view of the preferred embodiment, wherein a light source and a light transmittable rotary disk are omitted for the sake of clarity.

Referring to FIGS. 1 and 5, the air pump 21 is adapted to be mounted in the transmission chamber 11 for providing pressurized air in a known manner. The pressurized air is supplied to a pair of transporting tubes 34, each of which is connected to first ends of a pair of the first air passage tubes 34' by means of a three-way tubular connector. Each of the first air passage tubes 34' further has a second end opposite to the first end thereof and connected to the control unit 3. Each of the second air passage tubes 35 has a first end connected to and fluidly communicated with a respective one of the bubble emission members 23, and an opposite second end connected to the control unit 3.

Figure 6:
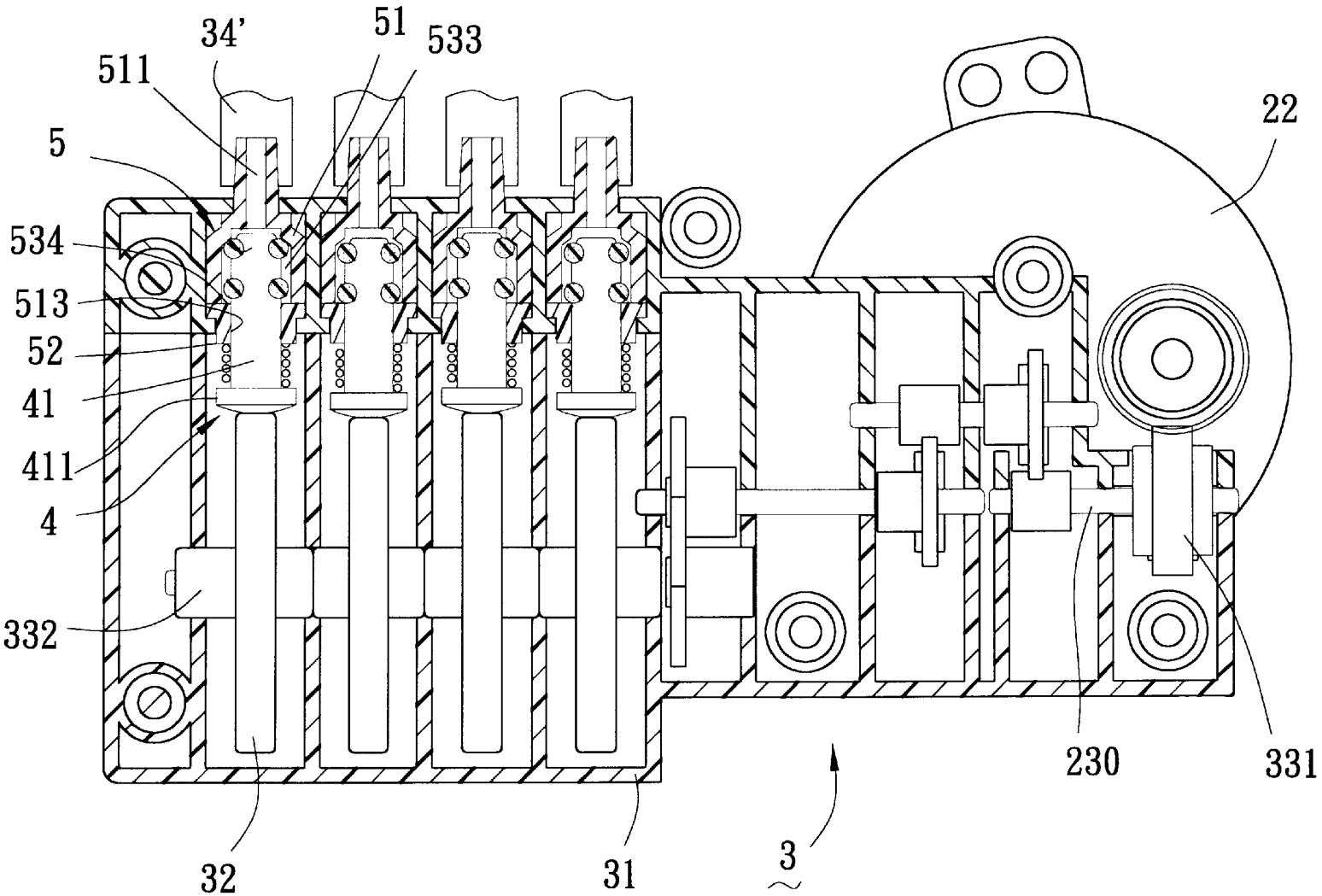
FIG. 6 is an enlarged fragmentary sectional view illustrating a control unit of the preferred embodiment.

Referring to FIGS. 5 and 6, the control unit 3 is adapted to be mounted in the transmission chamber 11, and includes a housing 31, four cam wheels 32 disposed respectively in four compartments of the housing 31, four valve units 4 mounted respectively in the compartments adjacent to the cam wheels 32, a rotary shaft 332, and a drive unit 22.

Figure 8:
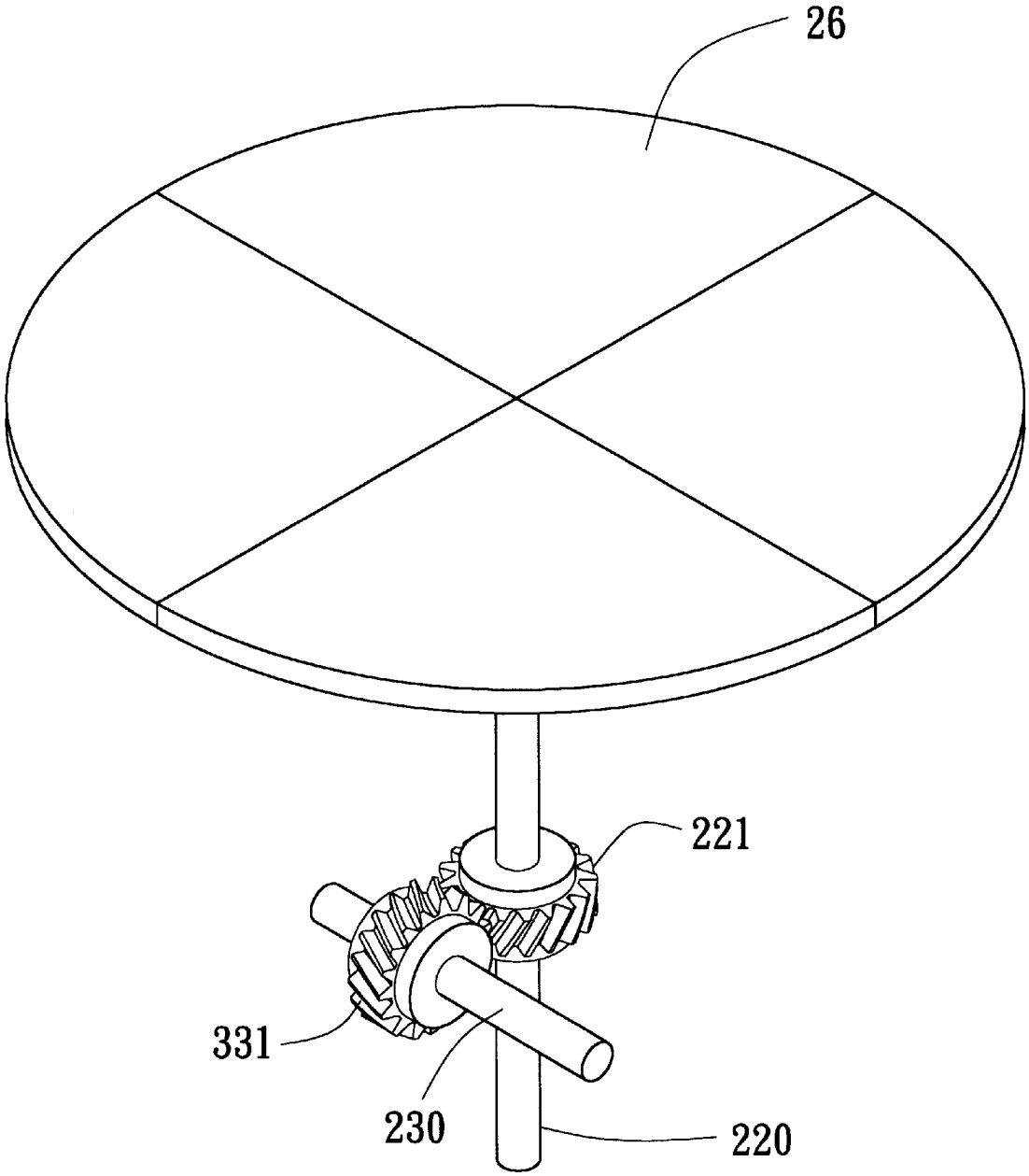
FIG. 8 is a perspective view illustrating how a rotary driving force is transmitted from a drive unit.

The cam wheels 32 are mounted securely on the rotary shaft 332 for co-rotation therewith. The cam wheels 32 are spaced apart along the length of the rotary shaft 332, and are oriented at different angular positions on the rotary shaft 332. The drive unit 22, in the form of a motor, is coupled to the rotary shaft 332 for providing a rotary drive force in a known manner. As shown in FIGS. 6 and 8, the drive unit 22 has a first transmission shaft 220 extending therefrom. The first transmission shaft 220 is coupled to a second transmission shaft 230 perpendicular to the first transmission shaft 220 by means of a first gear member 221 mounted securely on the first transmission shaft 220, and a second gear member 331 mounted securely on the second transmission shaft 230. The second transmission shaft 230 is parallel to the rotary shaft 332, and is coupled to the rotary shaft 332 such that a rotary driving force can be transmitted from the drive unit 22 to the rotary shaft 332 to cause axial rotation of the latter, thereby causing axial rotation of the cam wheels 32 with the rotary shaft 332.

Figure 7:
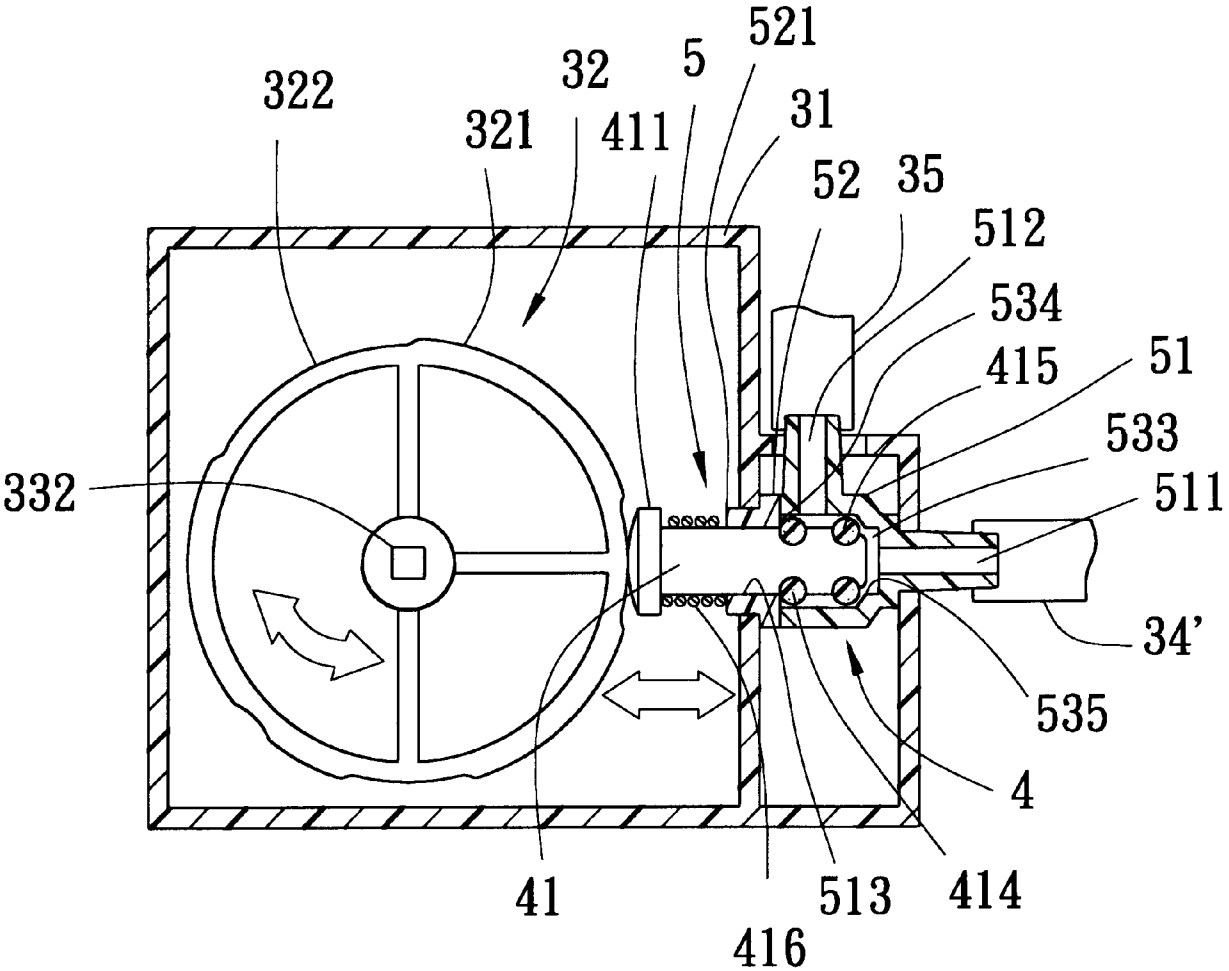
FIG. 7 is another enlarged fragmentary sectional view illustrating the control unit when viewed from another angle.

Referring to FIG. 7, each of the cam wheels 32 has a peripheral cam surface which is formed with a plurality of cam projections 321 with different arc lengths, and a plurality of indented groove portions 322 with different arc lengths. The groove portions 322 are indented radially relative to the cam projections 321, and are angularly displaced from the cam projections 321.

Referring to FIGS. 6 and 7, each of the valve units 4 includes a valve seat 5 mounted on the housing 31, and a spring-loaded piston rod 41. The valve seat 5 is made of plastic, and includes a hollow body 51 which is formed with an air chamber 533 and which has a tubular air inlet 511 formed adjacent to and communicated fluidly with the air chamber 533, and a tubular air outlet 512 formed adjacent to and communicated fluidly with the air chamber 533. The air outlet 512 is perpendicular to the air inlet 511. The air inlet 511 has one end extending out of the housing 31 and connected to the second end of a respective one of the first air passage tubes 34' for communicating fluidly therewith. The air outlet 512 has one end extending out of the housing 31 and connected to the second end of a respective one of the second air passage tubes 35 for communicating fluidly therewith. The pressurized air provided by the air pump 2 can thus reach the air inlet 511 via the corresponding first air passage tube 34', flow from the air inlet 511 to the air outlet 512 via the air chamber 533, and reach the bubble emission member 23 via the corresponding second air passage tube 35. The valve seat 5 further has a tubular piston holding portion 52 which is secured to one end of the hollow body 51 by known high-frequency sealing techniques. The piston holding portion 52 confines an axial piston hole 513 communicated with the air chamber 533. The piston hole 513 is registered with the air inlet 511. The piston holding portion 52 has a first end 521 proximate to the respective cam wheel 32, and an opposite second end disposed adjacent to the air chamber 533. The air chamber 533 has an annular inner surface which is formed with a first annular shoulder 535 that surrounds the air chamber 533. The first annular shoulder 535 extends radially and inwardly from the inner surface, and is inclined relative to the inner surface. The first annular shoulder 535 is disposed between the air inlet 511 and the air outlet 512, and converges in a direction toward the air inlet 511. The second end of the piston holding portion 52 defines a second annular shoulder 534 with the inner surface of the air chamber 533.

The piston 41 extends slidably through the piston hole 513 of the piston holding portion 52, and has a first end extending toward the peripheral cam surface of the respective cam wheel 32, and an opposite second end extending into the air chamber 533 and disposed between the air inlet 511 and the air outlet 512. The first end of the piston rod 41 is formed with an enlarged head portion 411. The second end of the piston rod 41 has an O-shaped first sealing ring 415 sleeved therearound. A second sealing ring 414 is sleeved around the piston rod 41 between the first and second ends, and is disposed in the air chamber 533. A biasing spring 416, which is in the form of a coiled compression spring, is sleeved around the piston rod 41 between the enlarged head portion 411 of the piston rod 41 and the first end 521 of the piston holding portion 52 for biasing the piston rod 41 to move toward the cam wheel 32 so as to keep the head portion 411 of the piston rod 41 in contact with the peripheral cam surface of the cam wheel 32. When the cam wheel 32 is rotated to register either one of the cam projections 321 with the piston rod 41, the piston rod 41 is pushed by the cam projection 321 to move in a direction toward the air chamber 533 against biasing action of the biasing spring 416 to a blocking position, in which the first sealing ring 415 is in sealing contact with the first annular shoulder 535 to block air flow from the air inlet 511 to the air outlet 512, thereby preventing air flow from the corresponding first air passage tube 34' to the corresponding second air passage tube 35 so as to prevent emission of bubbles via the corresponding bubble emission member 23. Further rotation of the cam wheel 32 subsequently registers either one of the groove portions 322 with the piston rod 41. Under such a condition, the piston rod 41 is moved toward the cam wheel 32, due to the biasing action of the biasing spring 416, to a non-blocking position, in which the first sealing ring 415 moves away from and forms a clearance with the first annular shoulder 535 so as to permit the air flow from the air inlet 511 to the air outlet 512 via the air chamber 533, thereby permitting air flow from the corresponding first air passage tube 34' to the corresponding second air passage tube 35 so as to permit emission of bubbles via the corresponding bubble emission body 23. When the piston rod 41 moves to the non-blocking position, the second sealing ring 414 abuts against the second annular shoulder 534 to prevent the air in the air chamber 533 from leaking through the piston hole 513. In this manner, the piston rod 41 is moved alternatingly toward and away from the air chamber 533 to alternatingly block and unblock the air flow from the air inlet 511 to the air outlet 512 during rotation of the cam wheel 32. Emission of bubbles via the corresponding bubble emission member 23 can thus be intermittently interrupted.

Referring to FIG. 1, a light source 25, such as a lamp, is provided in the transmission chamber 11 to provide a light output in an upward direction toward the water receiving chamber 10. A light transmittable rotary disc 26 is disposed in the transmission chamber 11 above the light source 25, and is coupled to the first transmission shaft 220 of the drive unit 22 (see FIG. 8) so as to be driven by the drive unit 22 to rotate together with the transmission shaft 220. Preferably, the rotary disc 26 is divided into several regions of different colors to convert the light output into one of varying colors.

A check valve 27 is provided in a respective one of the second air passage tubes 35 to prevent flow of water in the water receiving chamber 10 into the control unit 3.

Referring to FIGS. 1 and 5, each of the transporting tubes 34 is connected to the air pump 21 by means of an air releasing tube 28 which is formed with a radial vent hole 281 that permits venting of air therefrom so as to prevent over-pressurizing of the air in the transporting tube 34 and the corresponding first air passage tube 34'. However, the vent hole 281 has a suitable size so as to maintain a sufficient air pressure in the first air passage tube 34'.

Figure 9:
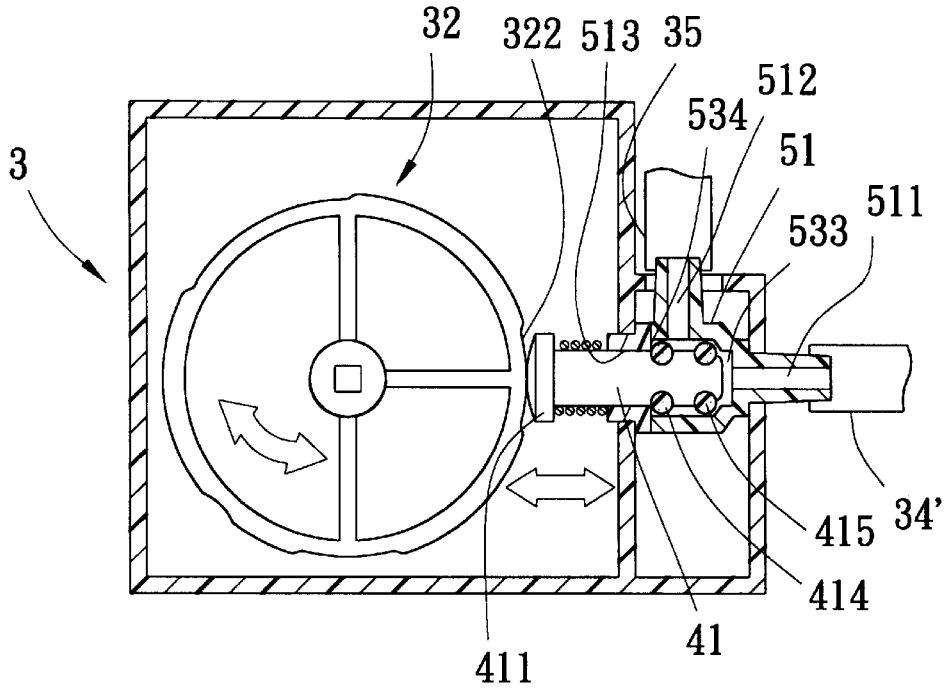
FIG. 9 is a fragmentary schematic sectional view illustrating the control unit of the preferred embodiment, wherein a piston rod is in a non-blocking position.
Figure 10:
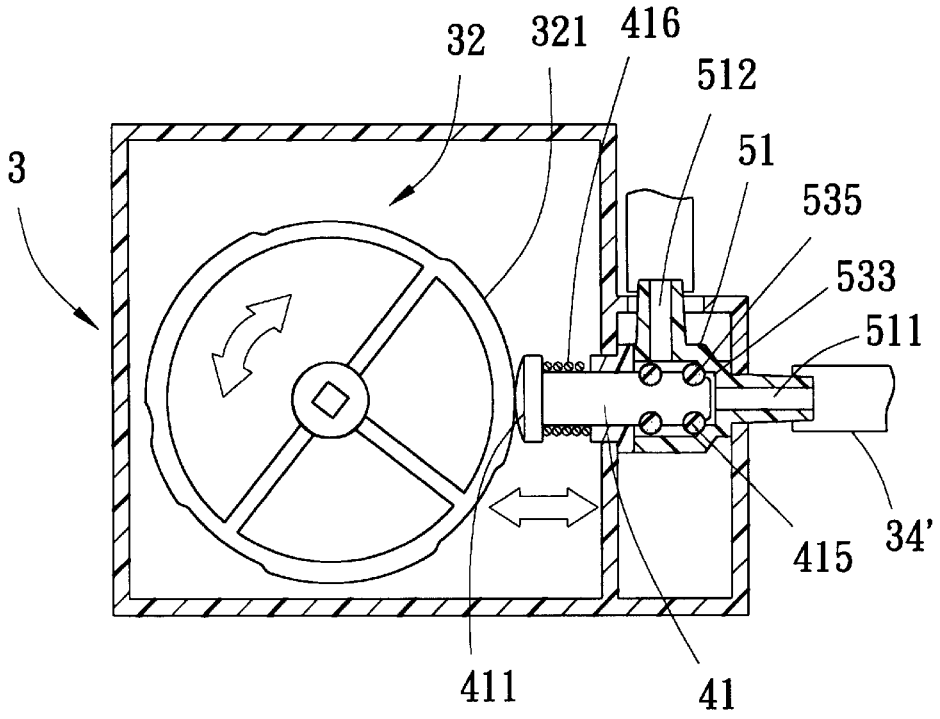
FIG. 10 is a fragmentary schematic sectional view illustrating the control unit of the preferred embodiment, wherein the piston rod is in a blocking position.

Referring to FIGS. 5, 9 and 10, in use, the air pump 21 and the drive unit 22 are activated to supply pressurized air into the first air passage tubes 34' and to drive rotation of the cam wheels 32. When each of the cam wheels 32 is rotated to align either one of the cam projections 321 thereof with the piston rod 41 of an adjacent valve unit 4, the piston rod 41 is pushed by the cam projection 321 to move against the biasing action of the biasing spring 416 toward the air chamber 533 to the blocking position, as shown in FIG. 10, in which the first sealing ring 415 contacts sealingly the first annular shoulder 535 to block the air flow from the air inlet 511 to the air outlet 512. At this time, bubbles are prevented from being emitted via the corresponding bubble emission member 23. When the cam wheel 32 is rotated continuously to align either one of the groove portions 322 thereof with the piston rod 41, the piston rod 41 is moved toward the cam wheel 32, due to the biasing action of the biasing spring 461, to the unblocking position, as shown in FIG. 9, in which the first sealing ring 415 is moved away from the first annular shoulder 535 and forms clearances with the first annular shoulder 535 and with the inner surface of the air chamber 533. At this time, air is permitted to flow from the air inlet 511 to the air outlet 512 such that bubbles are emitted via the corresponding bubble emission member 23. Since the piston rod 41 is registered alternatingly with the cam projections 321 and the groove portions 322 during rotation of the cam wheel 32, the piston rod 41 is moved alternatingly toward and away from the air chamber 533 to intermittently block the air flow through the adjacent valve unit 4, thereby intermittently interrupting the emission of bubbles via the corresponding bubble emission member 23.

In the present embodiment, the cam wheels 32 are oriented at different angular positions, as shown in FIG. 6, and the bubble emission holes 231 in the bubble emission members 23 are different in size. Bubbles of different sizes can thus be emitted via the bubble emission members 23 at different times. This provides a varying waterscape to the water tank 1.

It should be noted that the numbers of the bubble emission members 23 may be different from those of the first and second air passage tubes 34', 35, the cam wheels 32, and the valve units 4. For example, in a modified embodiment of the present invention, the bubble generating device may include a pair of first air passage tubes 34', a pair of second air passage tubes 35, a pair of valve units 4, and two pairs of bubble emission members 23. In this case, a pair of double-ended pipe connectors are used to connect the second air passage tubes 35 with the bubble emission members 23.

It has been shown that, with the use of the valve units 4 to control communication and dis-communication between the first and second air passage tubes 34', 35, bubbles emitted via the bubble emission members 23 can be intermittently interrupted to provide a varying waterscape to the water tank 1.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A bubble generating device for use with a water tank which has a water receiving chamber to hold water therein, said bubble generating device comprising:

a bubble emission member adapted to be disposed in the water receiving chamber of the water tank, said bubble emission member being formed with a plurality of bubble emission holes;

an air pump for providing pressurized air;

a first air passage tube with a first end connected to said air pump for receiving the pressurized air provided by said air pump, and an opposite second end;

a second air passage tube with a first end connected to said bubble emission member, and an opposite second end; and a control unit which includes a cam wheel rotatable about a rotary axis, and having a peripheral cam surface, a valve seat formed with an air chamber, an air inlet communicated fluidly with said air chamber and connected to said second end of said first air passage tube for fluidly communicating therewith, and an air outlet communicated fluidly with said air chamber and connected to said second end of said second air passage tube for fluidly communicating therewith, a spring-loaded piston rod having a first end portion extending toward said peripheral cam surface of said cam wheel, and a second end portion extending into said air chamber of said valve seat and disposed between said air inlet and said air outlet, said second end portion of said piston rod being provided with a valve piece, said piston rod being biased to move toward said cam wheel to keep said first end of said piston rod in contact with said peripheral cam surface of said cam wheel, and a drive unit coupled to said cam wheel for driving rotation of said cam wheel so as to permit said cam surface to intermittently push said piston rod toward said air chamber to enable said piston rod to move intermittently between a blocking position, in which air flow from said air inlet to said air outlet is blocked by said valve piece on said second end portion of said piston rod, thereby preventing air flow from said first air passage tube to said second air passage tube so as to prevent emission of bubbles via said bubble emission body, and a non-blocking position, in which said valve piece ceases to block the air flow from said air inlet to said air outlet, thereby permitting air flow from said first air passage tube to said second air passage tube and permitting emission of bubbles via said bubble emission body.

2. The bubble generating device according to claim 1, wherein said cam surface of said cam wheel is formed with at least one cam projection and at least one groove portion which is indented radially relative to said cam projection and which is angularly displaced from said cam projection, said cam wheel being rotatable to register said cam projection with said piston rod, thereby allowing said cam projection to push said piston rod for moving said piston rod to the blocking position, said cam wheel being further rotatable to register said groove portion with said piston rod, thereby allowing said piston rod to be biased toward said cam wheel for movement to the non-blocking position.

3. The bubble generating device according to claim 1, wherein said valve seat has an inner surface formed with an annular shoulder which extends inwardly from said inner surface and which surrounds said air chamber, said annular shoulder being disposed between said air inlet and said air outlet, said valve piece being formed as a sealing ring which is sleeved around said second end portion of said piston rod, said sealing ring being in sealing contact with said annular shoulder so as to block the air flow from said air inlet to said air outlet when said piston rod is moved to the blocking position, said sealing ring forming a clearance with said annular shoulder of said air chamber so as to permit the air flow from said air inlet to said air outlet when said piston rod is moved to the non-blocking position.

4. The bubble generating device according to claim 1, wherein said valve seat includes a tubular piston holding portion which permits said piston rod to extend axially and slidably therethrough, said piston holding portion having a first end proximate to said cam wheel and a second end distal to said cam wheel, said first end portion of said piston rod being formed with an enlarged head portion, said piston rod having a biasing spring sleeved therearound between said first end of said piston holding portion and said head portion of said piston rod for biasing said piston rod to move toward said cam wheel and to keep said head portion of said piston rod in contact with said peripheral cam surface of said cam wheel.

5. The bubble generating device according to claim 4, wherein said piston holding portion confines an axial piston hole through which said piston extends, said air inlet of said valve seat being registered with said piston hole.

6. The bubble generating device according to claim 4, wherein said air chamber has an inner surface that forms an annular shoulder with said second end of said piston holding portion, said valve unit further including a sealing ring sleeved around said piston rod between said first and second end portions of said piston rod, said sealing ring abutting against said annular shoulder to prevent leakage of air in said air chamber through said piston hole.

7. The bubble generating device according to claim 4, wherein said biasing spring is a coiled compression spring.

8. The bubble generating device according to claim 1, wherein said second air passage tube is provided with a check valve adapted to prevent the water in the water receiving chamber from flowing to said control unit via said second air passage tube.

9. The bubble generating device according to claim 1, further comprising an air releasing tube disposed between and communicated fluidly with said first air passage tube and said air pump, said air releasing tube being formed with a vent hole that permits venting of air therefrom to prevent over-pressurizing of the air in said first air passage tube.

10. The bubble generating device according to claim 2, comprising a plurality of said bubble emission members, a plurality of said first air passage tubes connected respectively to said air pump, and a plurality of said second air passage tubes connected respectively to said bubble emission members, said control unit including:

a plurality of said cam wheels rotatable about said rotary axis;

a plurality of said valve seats, said air inlet of each of said valve seats being connected to said second end of a respective one of said first air passage tubes, said air outlet of each of said valve seats being connected to said second end of a respective one of said second air passage tubes; and a rotary shaft which extends along said rotary axis and which is coupled to said drive unit so as to be driven by said drive unit to rotate axially, said rotary shaft having said cam wheels mounted thereon to permit axial rotation of said cam wheels together with said rotary shaft, said cam wheels being spaced apart along length of said rotary shaft and being oriented at different angular positions on said rotary shaft.

* * * * *

UNITED STATES PATENT AND TRADEMARK OFFICE

CERTIFICATE OF CORRECTION

PATENT NO. : 6,276,669 B1
DATED : August 21, 2001
INVENTOR(S) : C.-N. Yang

It is certified that error appears in the above-identified patent and that said Letters Patent is hereby corrected as shown below:

Title page,
Item [74], *Attorney, Agent or Firm*, "Christenson" should read -- Christensen --

Signed and Sealed this

Twenty-first Day of May, 2002

*Attest:*

*Attesting Officer*

JAMES E. ROGAN
*Director of the United States Patent and Trademark Office*